US005282433A

United States Patent [19]

Freermann et al.

[11] Patent Number: 5,282,433

[45] Date of Patent: Feb. 1, 1994

[54] DEVICE FOR APPLYING FABRIC WEBS OR LENGTHS OF FABRIC

[75] Inventors: Johannes Freermann; Dieter Malcherek, both of Ochtrup, Fed. Rep. of Germany

[73] Assignee: Carl Schmale GmbH & Co. KG, Ochtrup, Fed. Rep. of Germany

[21] Appl. No.: 849,429

[22] PCT Filed: Feb. 14, 1991

[86] PCT No.: PCT/DE91/00118

§ 371 Date: May 12, 1992

§ 102(e) Date: May 12, 1992

[87] PCT Pub. No.: WO91/13198

PCT Pub. Date: Sep. 5, 1991

[30] Foreign Application Priority Data

Feb. 22, 1990 [DE] Fed. Rep. of Germany ..... 9002121 [U]

[51] Int. Cl.[5] ..... D05B 35/10; D05B 27/12

[52] U.S. Cl. ..... 112/153; 112/306; 112/304

[58] Field of Search ..... 112/27, 7, 153, 303, 112/306, 141, 143

[56] References Cited

U.S. PATENT DOCUMENTS

| | | | |
|---|---|---|---|
| 1,093,105 | 4/1914 | Hudson | 112/151 |
| 3,450,075 | 6/1969 | Bridgeman | 112/27 |
| 3,457,885 | 7/1969 | Saltiel | 112/27 |
| 3,527,181 | 9/1970 | Beamon | 112/27 |
| 4,509,440 | 4/1985 | Freerman | 112/153 |
| 4,615,287 | 10/1986 | Henze et al. | 112/153 X |
| 5,165,353 | 11/1992 | Freerman | 112/153 |

*Primary Examiner*—Clifford D. Crowder
*Assistant Examiner*—Paul C. Lewis
*Attorney, Agent, or Firm*—Herbert Dubno; Yuri Kateshov

[57] ABSTRACT

A device for applying fabric webs includes upper and lower runners each formed with a respective edge facing a pile edge of the web and provided with respective first, second and third segments which are differently shaped and provide aligning of the edge and a seam during hemming and sewing operations.

4 Claims, 2 Drawing Sheets

DEVICE FOR APPLYING FABRIC WEBS OR LENGTHS OF FABRIC

CROSS REFERENCE TO RELATED APPLICATIONS

This application is a national phase application of PCT/DE91/00118 filed 14 Feb. 1991 and based upon a German Application G90 02 121.5 filed 22 Feb. 1990.

FIELD OF THE INVENTION

The invention relates to a device for applying fabric webs or lengths of fabric, particularly of fabrics covered by pile on both sides, with a pile-free area (smooth-woven fabric) adjacent the pile area, in order to feed the fabric webs or lengths of fabric to hemming and sewing stations equipped with a conveying device consisting of a pair of belts.

BACKGROUND OF THE INVENTION

The concept "covered by pile" applies to any desired thickening of a fabric, such as terry cloth, looped or tufted fabrics or the like. In the processing of such goods difficulties have arisen, particularly during hemming and sewing, since it is difficult to obtain a hem or a seam precisely applied to the pile edge without particular care from the operator. However, the latter costs time and money.

OBJECT OF THE INVENTION

It is therefore the object of the invention to provide a device for applying such fabric webs during hemming and sewing, so that the seam to be formed will run precisely along the pile and that no pile loops will be stitched into the seam.

SUMMARY OF THE INVENTION

The device according to the invention includes an upper runner resiliently mounted on an intermediate device and a lower runner rigidly mounted on a frame. A step-like formation provided on respective running edges of the runners is a simple and cost-efficient way to process terry cloth to be hemmed. The stitching of pile loops is certainly avoided. The device is operated at allows high operational speeds with low skill requirements for the operator. The device can work with a tolerance of about 4 mm with respect to the reference line when inserting the fabric web, because the edges of the runners are shaped so that the pile is always pushed back from the pile-free area.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
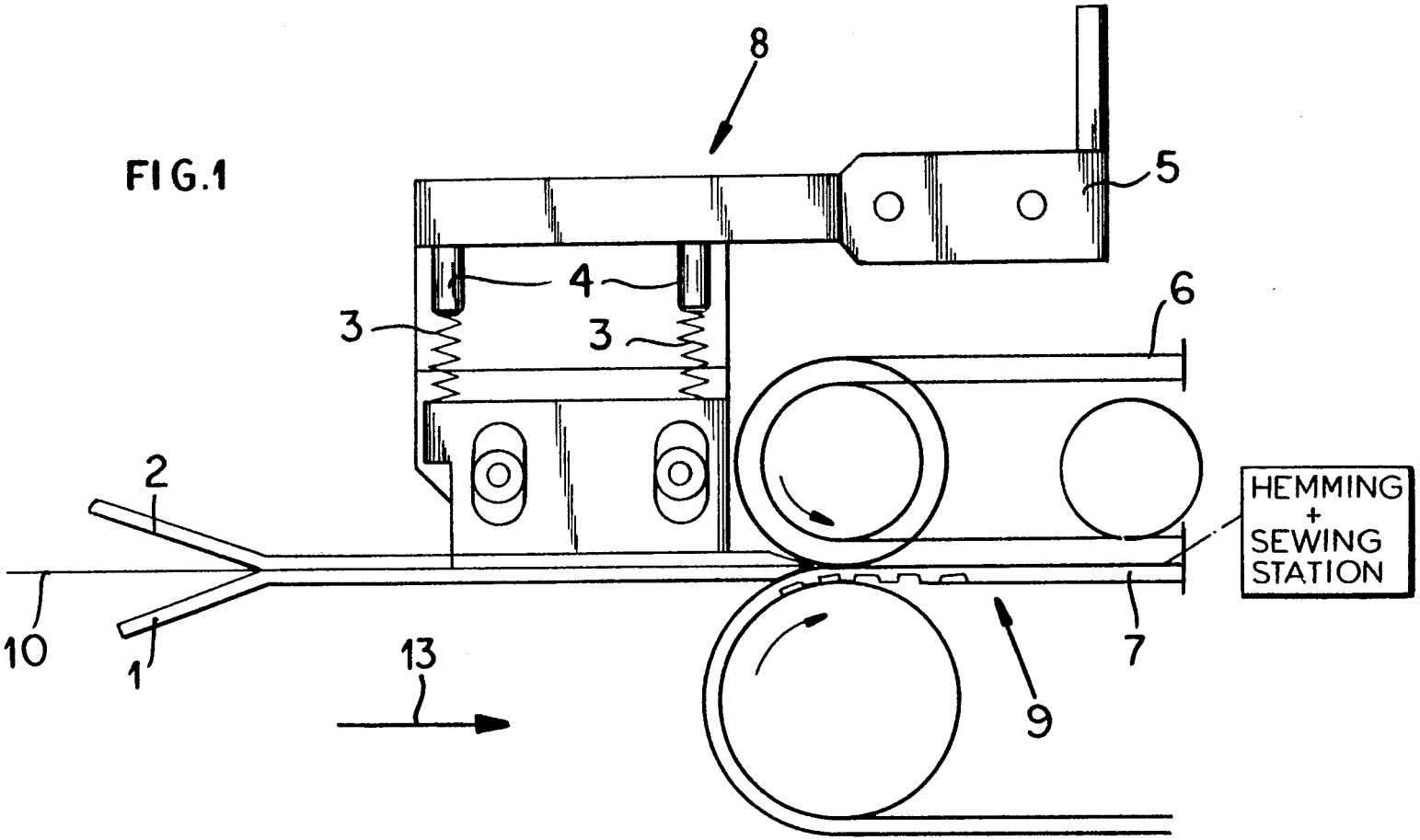
FIG. 1 is a lateral elevation view of the device according to the invention.

FIG. 1 shows the device in a side view. It is designed as an intermediate device 8, preceding a conveying device 9 and fastened via a bracket 5 to the machine frame. An essential part of the device are two runners 1, 2. The runner 1 is a rigid support under the fabric web 10 and the runner 2 is resiliently suspended on the intermediate device 8. The contact pressure of runner 2 can be varied by means of screw bolts 4 acting upon springs 3. The conveying device 9 consists in a manner known per se of two endless belts 6, 7, which at their contact surfaces take over the fabric web 10 and move in the direction of arrow 13 towards a hemming and sewing station (not shown in the drawing). The fabric web 10 to be inserted is introduced manually between the two runners 1, 2. Beyond the runners 1, 2, the fabric web 10 is taken over by the belts 6, 7 of the conveying device 9, whereby the plane between the two runners 1, 2 and the two mutually touching belt segments 6, 7 are at the same level.

Figure 2:
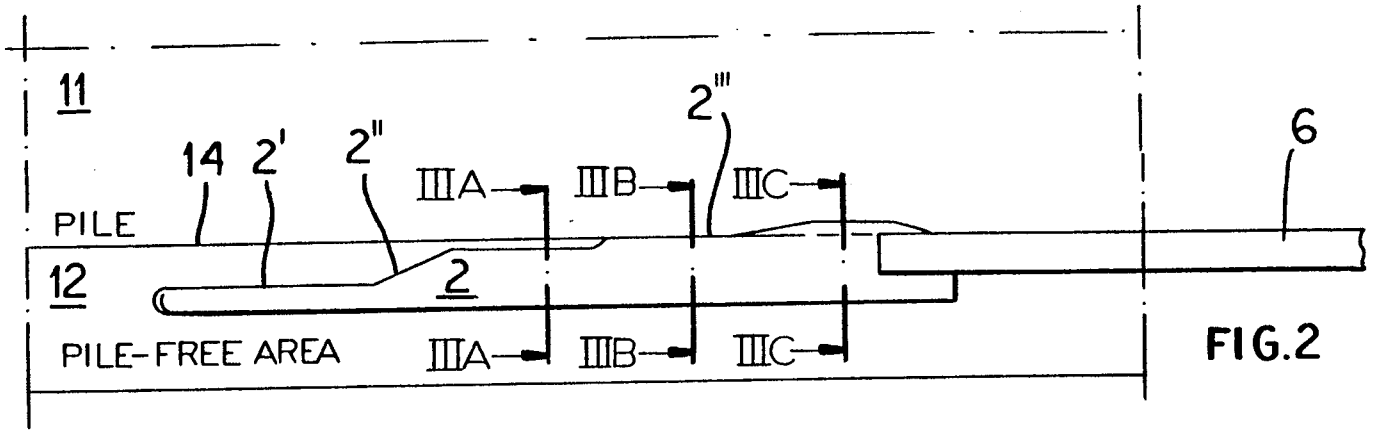
FIG. 2 a top diagrammatic view of the device shown in FIG. 1.

FIG. 2 shows a top view of the device. The fabric web 10 consisting of a pile area 11 and a pile-free area (smooth-woven fabric) 12 has a pile edge 14, along which the goods are supposed to be hemmed and sewn. In the top view the runner 2 can also be seen, while the runner 1 located underneath is covered by the fabric web 10. The runners 1 and 2 are basically identically shaped, however the lower runner 1 can be shorter. Respective edges of the runners facing the pile edge 14 recedes stepwise, so that a narrow initial segment 2' is followed by an inclined portion 2'' and a curved segment 2''', whose end reaches over the pile edge 14. Having such a structure, the operator does not have to exercise special care during the insertion of the goods, the fabric can also be inserted with the pile edge 14 deviated with respect to the runner edge because due to the steplike configuration of the runner edge, the fabric is always precisely aligned before it enters the conveying device 9.

Figure 3A:
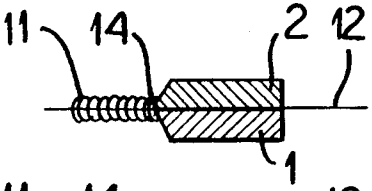
FIG. 3A is a cross sectional view along line III A—III A shown in FIG. 2.
Figure 3B:
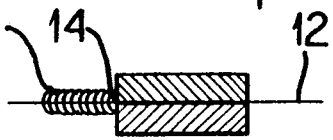
FIG. 3B is a cross sectional view along line III B—III B shown in FIG. 2.
Figure 3C:
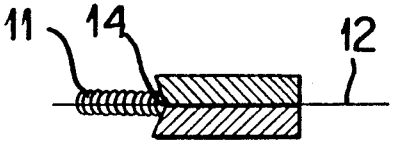
FIG. 3C is a cross sectional view along line III C—III C shown in FIG. 2.

FIGS. 3A-3C show three sections IIIA—A; III-B—B; IIIC—C of FIG. 2. The section A-B is in the second step and it shows the two runners 1, 2 pressing back the pile edge 14 of the pile area 11 with their pointed bevelling. In the next section C-D the blunt runner edge has reached the pile edge 14 and in the section E-F the runner edge is shaped like an arrow when seen from the pile area 11, whereby its outer edges project over the pile edge 14.

We claim:

1. An apparatus for supplying a web of fabric formed with a pile covered area and a pile-free area to hemming and sewing stations, the pile covered and pile-free areas defining a transition area including a longitudinal pile edge therebetween, said device comprising:

a frame;

a conveying device including a pair of endless belts on the frame for conveying the web toward said hemming and sewing stations; and an intermediate device mounted on the frame upstream of said conveying device and including:

a lower guide mounted rigidly on the frame, and an upper guide mounted resiliently on the frame and juxtaposed with the lower guide across the web, the lower and upper guides extending toward the conveying device and terminating next to the conveying device, each of the guides being formed with a respective longitudinally extending stepped guide edge in the transition area of the web and being provided with:

a respective upstream segment running longitudinally parallel to and spaced from the pile edge, a respective intermediary segment downstream of the upstream and running therefrom at an angle toward the pile edge, and a respective downstream curved longitudinal segment downstream of the intermediary segment and having a portion aligned with the pile edge, so that the pile edge comes in contact with the guide edges of the guides immediately upstream of said conveying device.

2. The device defined in claim 1 wherein the guide edges of the upper and lower guides are formed with respective surfaces facing the pile edge, the surfaces converging toward one another and toward the pile edge along the upstream segments in the pile-free area and being aligned with one another along the intermediary segments and diverging from and projecting over the pile edge into the pile area of the web along the downstream segments.

3. The device defined in claim 1 wherein the intermediary device further includes:

a housing mounted on the frame;

at least one spring bearing upon the upper guide; and at least one screw bolt operatively connected with the spring for varying a contact pressure between the upper guide and the web.

4. The device defined in 1 wherein each of the guides is provided with a respective upwardly bent shoe.

* * * * *